US007459621B2

(12) United States Patent
Straubinger

(10) Patent No.: US 7,459,621 B2
(45) Date of Patent: Dec. 2, 2008

(54) PAD ASSEMBLY FOR WOODWINDS, PARTICULARLY FLUTES

(76) Inventor: David J. Straubinger, 5920 S. East St., Indianapolis, IN (US) 46227

( * ) Notice: Subject to any disclaimer, the term of this patent is extended or adjusted under 35 U.S.C. 154(b) by 0 days.

(21) Appl. No.: 11/832,802

(22) Filed: Aug. 2, 2007

(65) Prior Publication Data

US 2008/0028914 A1 Feb. 7, 2008

Related U.S. Application Data

(60) Provisional application No. 60/821,151, filed on Aug. 2, 2006.

(51) Int. Cl.
*G10D 9/04* (2006.01)

(52) U.S. Cl. ..... 84/385 P

(58) Field of Classification Search ..... 84/385 P
See application file for complete search history.

(56) References Cited

U.S. PATENT DOCUMENTS

| | | | | |
|---|---|---|---|---|
| 1,681,220 | A * | 8/1928 | Ciccone | 84/380 R |
| 4,704,939 | A * | 11/1987 | Straubinger | 84/385 P |
| 5,183,954 | A * | 2/1993 | Wasser | 84/385 P |
| 5,417,135 | A * | 5/1995 | Straubinger | 84/385 P |
| 5,469,771 | A * | 11/1995 | Wasser | 84/385 P |
| 6,028,256 | A * | 2/2000 | Straubinger | 84/385 P |
| 6,284,958 | B1 * | 9/2001 | Aoki et al. | 84/385 P |
| 6,344,604 | B1 * | 2/2002 | Schmidt | 84/385 P |
| 6,664,455 | B2 * | 12/2003 | Aoki | 84/385 P |
| 6,683,235 | B2 * | 1/2004 | Aoki | 84/385 P |
| 6,972,361 | B2 * | 12/2005 | Shibamiya et al. | 84/385 P |
| 7,396,984 | B2 * | 7/2008 | Straubinger | 84/385 P |
| 2007/0006714 | A1 * | 1/2007 | Kuo | 84/385 P |
| 2008/0028914 | A1 * | 2/2008 | Straubinger | 84/385 P |

* cited by examiner

*Primary Examiner*—Walter Benson
*Assistant Examiner*—Robert W Horn
(74) *Attorney, Agent, or Firm*—Woodard, Emhardt, Moriarty, McNett & Henry LLP

(57) ABSTRACT

Self-leveling pad assemblies are described having novel supports that include backing disks and compensating disks. The backing disks have inner and outer collars on its second surface and a flexible compensating disk supported on the outer collar creating a cavity between the two collars and the two disks. The assemblies self-leveling properties result from the compensating disk's ability to flex or bend into the cavity and allow the sealing and cushion layers to conform to the contour of the instrument's tone hole. Self-leveling pad assemblies according to the present disclosure are particularly useful on woodwind instruments that include flutes, clarinets and the like. The compensating disk, having limited flexibility, provides sufficient support for the pad's sealing surface, maintains an even tension on the pad's skin, has sufficient flexibility to allow the pad's surface to conform to an imperfect tone hole and to seal with only a cursory leveling procedure and reduces the number of tears in the pad's skin resulting from repeated forceful contacts with the tone hole to create a seal and from fluctuations in the skin's moisture content.

31 Claims, 9 Drawing Sheets

PAD ASSEMBLY FOR WOODWINDS, PARTICULARLY FLUTES

This application claims the benefit of U.S. Provisional Application No. 60/821,151 filed Aug. 2, 2006, which is hereby incorporated by reference.

BACKGROUND

This disclosure relates generally to a tone hole covering for wind instruments, pad assemblies incorporating the novel support, and wind instruments having a pad assembly containing the novel support. The novel support is capable of flexing to conform the pad's sealing surface to the tone hole and provide an effective seal. The support's flexibility allows the pad to conform to the surface of a tone hole with minimal pressure even when not precisely adjusted and reduces damage and wear caused by the excess pressure needed to seal an un-leveled pad assembly. Although generally applicable to all woodwind instruments including flutes, oboes, bassoons and saxophones, embodiments of the present disclosure are particularly suited for use in flutes, clarinets and piccolos.

During this century, instrument tone hole coverings, also called pad assemblies or simply pads, have typically comprised a cardboard backed wool felt disk covered with Goldbeater's skin, wrapped around the cardboard and glued to its backside. The pad is fixed in a pad cup mounted over an instrument tone hole on a hinged mechanism so that the tone hole is sealed when the pad is in its closed position. Although such pads can initially be made to seal well, sensitivity to its environment and lack of dimensional stability of the felt and skin causes the pad surface to lose its integrity and allow air to leak at the interface between the pad and the tone hole.

U.S. Pat. No. 4,704,939 issued in 1987, disclosing a new pad that can maintain a flat sealing surface regardless of variations in temperature, moisture, or altitude. As a result of this design, pad life is extended and closure of the tone hole consistently requires only a light touch by the musician. To accomplish these advantages, the improved pad has a semi-rigid supporting unit for the felt. The pad's design allows its surfaces to be tilted to fit a tone hole with a perfectly planar surface through the leveling process of triangulation or, by a wedging action, to distort the planar surface to perfectly match a damaged or imperfect tone hole.

These improved pads could be constructed by stretching a skin across a cushion ring fitted within a recess formed between inner and outer collars on the lower radial face of a rigid backing disk having a bendable lower margin. The skin is folded around the edge of the backing disk and secured to the disk's back side. The pad is secured to its cup with a retainer comprising a washer and a screw combination attached to a pad nut which is in turn attached to the bottom of a pad cup and centrally located within the cup's cavity. Upon tightening the retaining screw of the assembled unit, the flat washer forces the skin against the rigid inner collar. Other methods are also known for securing the pad assembly within the pad cup, including the usual friction held retainer utilized in French or open-hole pads.

Further improvements in pad design and methods of seating pad assemblies have been made which utilize a stabilizing disk locked in an adjusted position with an adhesive, to better support a flexible backing disk having inner and outer collars. As before, a cushion layer of uniform thickness is positioned between the inner and outer collars covered by the pad's sealing surface covered with a skin. Should the pad need further adjustment, the pad's surface can be made to coincide with the tone hole's surface by the usual wedging action of partial shims placed between the stabilizing and backing disks. U.S. Pat. No. 6,028,256 issued in 2000, and teaches that tension on the pad's skin can be reduced by providing the backing disk's outer collar with an upper curved lip formed by undercutting the backing disk's outer collar. The improved backing disk minimizes damages to a pad assembly's skin due to repeated contacts with a tone hole and environmental conditions.

Although pads manufactured according to these improved designs have performed well, rigorous leveling of pads is still required when initially installed on a flute and from time-to-time during the pad's lifetime. Because the leveling process is both time consuming and expensive a pad assembly is needed that is capable of conforming to the tone hole's surface without a rigorous leveling procedure and without sacrificing tone, touch, and other performance attributes important to the musician. The present disclosure addresses these needs.

SUMMARY

As will become apparent from the following discussion, this disclosure provides for a novel support and pad assembly containing the novel support that enable the pad to form a seal with its corresponding tone hole regardless of whether its sealing surface is level or whether the pad was perfectly leveled.

One aspect of the present disclosure is directed to a support for a pad assembly for the closure of a wind instrument's tone hole. The support comprises a backing disk and a compensating disk. The backing disk has first and second surfaces and inner and outer collars positioned on the backing disk's second surface. The edges of the collars can be straight or curved and the various positions along the curved edges of the collars represent a portion of the outer and/or inner collars. The compensating disk has first and second surfaces and inner and outer regions. The compensating disk's outer region is adapted to be positioned over at least a portion of the backing disk's outer collar and the compensating disk's inner region is adapted to extend in the direction of the inner collar creating a cavity between the backing disk's second surfaces and the compensating disk's first surface. The compensating disk's inner region can fall short of the inner collar, extend to the edge of the inner collar, can rest on a curved edge of the inner collar or be positioned over the inner collar. The compensating disk can be made from a metal, polymer or rubber material providing the disk has a thickness that provides a measure of flexibility when a force is exerted on its second surface. The ability of the compensating disk to pivot or flex in the region over the backing disk's cavity when subjected to a force allows a pad surface containing the support to conform to the surface of an imperfect tone hole without requiring the normal time consuming leveling process.

A further aspect of the present disclosure is directed to a pad assembly for closure of a wind instrument tone hole comprising the novel support described above. Such a pad assembly can have (a) a backing disk having first and second surfaces, outer and inner collars positioned on the backing disk's second surface; (b) the combination of a compensating disk having first and second surfaces and at least one cushion layer in contact with at least one surface of the compensating disk where the combination is adapted to be positioned opposite the backing disk's second surface and in contact with the outer collar creating a cavity between the backing disk and the combination; and (c) a sealing surface in contact with at least one cushion layer and covering the combination. At least one cushion layer is in contact with the compensating disk's second surface. A second cushion layer can optionally be positioned in contact with the compensating disk's first surface and preferably bonded to the compensating disk with an adhesive layer. Cushion layers are typically made from a felt or felt-like material whereas the sealing surface is typically Goldbeater's skin or the like.

A still further aspect of the present disclosure is directed to a wind instrument having the pad assembly described above positioned over at least one tone hole. Particularly preferred wind instruments include clarinet, piccolo and flute.

Pad assemblies having the improved pad assemblies having the novel support provide a pad surface with varying ability to conform to the surface of a tone hole. For example, pad assemblies having a compensating disk that does not extend to the inner collar, that is constructed of a particularly flexible material, or a combination thereof typically can provide a pad surface with a greater ability to conform to an imperfect tone hole and require only a cursory leveling procedure. Similarly, pad assemblies having a particularly flexible compensating disk positioned over both collars can provide a pad surface with a significant ability to conform to an imperfect tone hole and require only a cursory leveling procedure. By selecting a compensating disk's material of construction, its thickness, and determining the location of its inner region, pad assemblies containing the novel support can provide a measure of ability to self-adjust.

The pad assemblies utilizing the novel backing disk provide a range of ability to self-level without sacrificing tone quality or significantly changing the feel to the musician. As a result, the novel pad assemblies can be employed in a wide variety of instruments ranging from student instruments to handmade professional instruments. Although the support and pad assembly is particularly suited for flutes, other instruments, particularly clarinets, can similarly benefit from applicant's improved support and pad assembly.

DRAWINGS

DESCRIPTION

Figure 1:
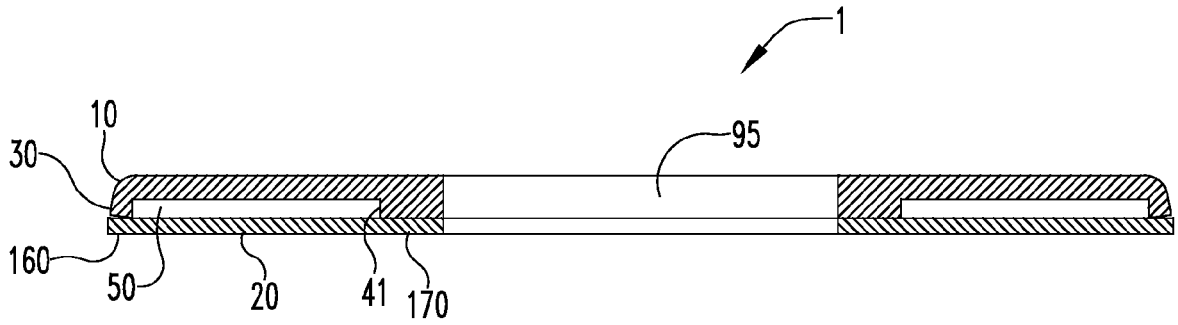
FIG. 1 illustrates a lateral view of a support for a pad assembly that includes a backing disk having inner and outer collars and a compensating disk positioned over the collars creating a cavity therebetween.

For the purposes of promoting an understanding of the principles of this disclosure, references will now be made to several embodiments and specific language will be used to describe the same. It will nevertheless be understood that no limitation of the scope of the disclosure is thereby intended, such alterations and further modifications and applications of the principles of the disclosure as described herein being contemplated as would normally occur to one skilled in the art to which the disclosure relates.

This disclosure relates to a novel support for a pad assembly that comprises a backing disk and compensating disk, pad assemblies that incorporate the novel support, and woodwind instruments having at least one novel pad assembly positioned over at least one tone hole. Pad assemblies incorporating the new supports have a degree of self-leveling ability and can adjust to the contour of an imperfect tone hole with minimal pressure to seal the tone hole. Additionally, pad assemblies incorporating the new supports require a less rigorous leveling procedure to provide the necessary seal. Finally pad assemblies having the novel supports are able to maintain an even tension on the pad's skin that further reduces the incidence of tears in the skin resulting from fluctuations in moisture and repeated contacts with the tone hole surface. Finally, the self-leveling properties afforded pad assemblies containing the novel support allow the pad assemblies to be installed with only a cursory leveling procedure that reduces pad installation costs.

Embodiments of this disclosure are applicable to a variety of woodwind instruments, particularly to piccolos, flutes and clarinets. For flutes, the embodiments are applicable to both open (French) and closed hole covering assemblies. Conventional tone hole covering assemblies are composed of several components described in detail below.

As used herein, the term pad cup refers to a shallow cylindrical cup having cylindrical walls and an endplate attached to one side. Closed hole assemblies have a solid endplate attached to one side and a pad nut or short column centrally located within the pad cup and attached to the endplate. The end plate can be planar to receive a backing disk directly or non-planar and shaped to receive a stabilizing disk having at least one planar surface that can in turn accept a backing disk. The endplate for an open hole assembly frequently used for flutes has a central cavity with a chimney or short cylindrical column within the pad cup, attached to the endplate and centrally located so that cavities within the chimney and the endplate form a continuous region.

A pad assembly for a flute is typically composed of a backing disk and cushion layer covered by a sealing surface means generally comprising one or more layers of a sealing skin. The cushion layer can be a single layer of material or be composed of multiple layers. The pad assembly is held within the pad cup by a retainer. The term retainer commonly refers to a washer and fastener combination having means for attaching the fastener to the centrally located pad nut and retaining the pad assembly within the closed hole pad cup. For closed hole flutes the retainer is commonly a threaded shaft. For open hole assemblies, the retainer generally comprises a friction held collar positioned within the open hole pad cup's chimney. For closed hole flutes, the more common means for attaching a retainer's threaded shaft to the pad nut includes a threaded cavity centrally located within the pad nut.

The term "second side" utilized in referring to specific sides of a stabilizing disk, a backing disk, a compensating disk or a pad assembly, refers to the side of the structure facing the pad's sealing surface when the components have been assembled and installed within a pad cup. The term "first side" similarly refers to the side of a structure facing opposite the pad's sealing surface in the assembled structure. A stabilizing disk is a washer-shaped disk having at least one planar surface, an opening within the disk's central region sufficiently large to fit over the central pad nut or chimney. A stabilizing disk can be rigid or have a region located at or near the disk's circumference which can deflect to conform the surface of its second side to the contour of the tone hole surface. The stabilizing disk can be made of metal, a polymeric material, or a combination of these materials. Stabilizing disks made from polymeric materials can be cut, machined, or molded from stock materials. For pad assemblies with a particularly thick cushion layer a pad cup having a flat inner surface can be used making it possible to place the pad assembly into the pad cup without the need for a stabilizing disk.

Backing disks are disks, generally washer-shaped disks having at least on planar surface capable of supporting a cushion layer covered with a skin attached to the backing disk's first or back side. Backing disks may additionally have inner and outer collars forming a recess there-between to receive the cushion layer or only an outer collar. Backing disks can be constructed of metal or polymer. Preferred metals include, but are not limited to steel, brass, titanium, copper, nickel, tin and aluminum. Preferred polymers include, but are not limited to polypropylene, polycarbonate, polyethylene, polyoxymethylene(acetal) and polytetrafluoroethylene.

One aspect of the present disclosure is a modified backing disk and a compensating disk combination that supports a cushion layer with the ability to flex when the cushion layer is subjected to pressure caused by contact with a raised region of a tone hole. The backing disk has first and second surfaces, the second surface having outer and inner collars. The inner and outer collars can have straight edges or walls, curved edges or walls, or a combination thereof. The compensating disk similarly has first and second surfaces, inner and outer regions, and is adapted to be positioned against the backing disk's second surface over at least a portion of the outer collar creating a cavity between the backing disk's second surface and the compensating disk's first surface. A portion of a collar includes either a portion of the collar's surface or for collars having curved edges, a position along a curved edge. The compensating disk's inner region extends in the direction of the inner collar. The compensating disk's outer region can stop before reaching the inner collar, can abut the inner collar, can rest on a portion of a curved wall of the inner collar, or can rest upon the surface of the inner collar. Further, a compensating disk that rests upon both collars can be free or fixed to the collar with an adhesive or the like.

In a pad assembly that includes the novel backing disk and compensating disk combination, the cavity formed by the collars between the backing disk and the compensating disk is positioned generally congruent with the region of the cushion layer that contacts and seals a tone hole. This arrangement allows the cushion layer and the compensating disk to flex or bend into the cavity when a peak region of a tone hole impacts the cushion layer of the pad assembly. By bending or flexing in this way, the pad assembly is able to conform to the surface of a tone hole and provide a necessary seal without requiring the rigorous leveling procedure normally required. By selecting the material of construction, the compensating disk's thickness, and whether adjustment occurs by bending or flexing, a pad assembly's touch and ability to self-adjust can be varied to suit a particular need.

One preferred embodiment of the novel support combination involves a backing disk having inner and outer collars and a compensating disk positioned over the collars creating a cavity therebetween and having the ability to flex into the cavity upon encountering a force such as encountered when a pad is closed by a musician. Similarly, the compensating disk can be adapted to be positioned over and in contact with a curved wall of the outer collar, a curved wall of the inner collar or a combination thereof provided contact with at least a portion of the outer collar is achieved. The cavity can lack any structures or contain structures that modify the compensating disk's flexing motion. For example, the placement of one or a plurality of ridges within the cavity beneath the compensating disk contained in a pad assembly modifies the assembly's touch and ability to self adjust. The introduction of structures within the cavity typically has this effect regardless of whether the compensating disk functions by bending or flexing. The number of structures present, their height, and the distance between the structures impact the touch and the level of self-adjustment achieved. Generally a fewer number of structures within the cavity having a maximum distance from the first side of the compensating disk and from adjacent structures enable a pad assembly containing the support to self adjust to more severely damaged or otherwise faulty tone holes.

One preferred embodiment of the novel support combination involves a backing disk having inner and outer collars and a compensating disk positioned over only the outer collar or only the curved wall of the outer collar creating a cavity therebetween. The inner region of the compensating disk extends in the direction of the inner collar without resting on it. Because the inner region of the compensating disk is unsupported it has the ability to bend into the cavity upon encountering a force such as encountered when a pad is closed by a musician. Like the earlier embodiment discussed, the cavity can lack any structures or contain structures that modify the compensating disk's bending motion. Again, ridges are preferred structures for placement within the cavity and these structures similarly impact a pad assembly's touch and ability to self adjust.

The new backing disks can be made of metal or a polymeric material. Backing disks made from polymeric materials can be cut, machined, or molded from stock materials. Backing disks made from polymeric materials are generally preferred. The novel compensating disks can be made of metal or polymeric materials. Suitable metals include, but are not limited to, steel, brass, titanium copper, nickel, tin and aluminum. Again, polymeric materials are generally preferred. Suitable polymeric materials include, but are not limited to, polypropylene, polycarbonate, polyethylene, polyoxymethylene(acetal) and polytetrafluoroethylene. Particularly preferred polymeric materials, such as rubbers, have elastic properties. Particularly suitable rubber materials include, but are not limited to, neoprene rubbers, fluoroelastomeric rubbers, silicone rubbers, natural rubbers, nitrile rubbers, latex rubbers, styrene butadiene rubbers, Hypalon® rubbers, polyisoprene rubbers, EPDM rubbers and polyurethane rubbers.

The cushion utilized in pad assemblies is a washer shaped disk made from a compressible material sized to fit against the backing disk's second side in the region of the pad assembly that will contact the tone hole surface. The cushion can be constructed from any material having a uniform thickness that can be cut into rings or otherwise formed. Single or multiple layers of cushion material can be employed. The cushion material must be capable of both supporting the pad's sealing surface and providing sufficient flexibility to conform to the tone hole's surface. Suitable cushion materials include natural materials such as wool felt and synthetic materials such as ULTRASUEDE, SCOTTFELT (mfr grade 900) or compressible polymers such as polyurethanes, silicon rubber and the like. ULTRASUEDE is a synthetic suede having polyester fibers impregnated with polyurethane manufactured by the Toray Co. Ltd. of Japan. SCOTTFLET is a registered trademark of the Scottfoam Corporation of Eddystone, Pa.

The skin utilized to cover the cushion and backing disk has traditionally been a membrane made from animal intestines. The skin is sometimes referred to as "fish skin" or "Goldbeater's skin". The skin is sensitive to moisture from the atmosphere, the musician's breath and saliva and changes its dimensions according to its moisture level.

A typical pad assembly is mounted in a pad cup containing a stabilizing disk resting against the pad cup's end-plate with an adhesive layer. The pad assembly can comprise a backing disk, a cushion and a sealing surface, typically a layer of a skin, covering the cushion and collars and fastened to the backing disk opposite the cushion and collars with an adhesive. The pad assembly is held in the pad cup with a retainer that includes a washer and screw engaged within a pad nut. The stabilizing and backing disks can be rigid or flexible. Because wind instruments and flutes vary in size, as do their tone holes, the dimensions of tone hole pads must vary accordingly. Generally pad cups have internal diameters ranging from about 0.300 to 0.750 inches and corresponding pad assemblies are sized to fit closely within the pad cup.

Figure 2:
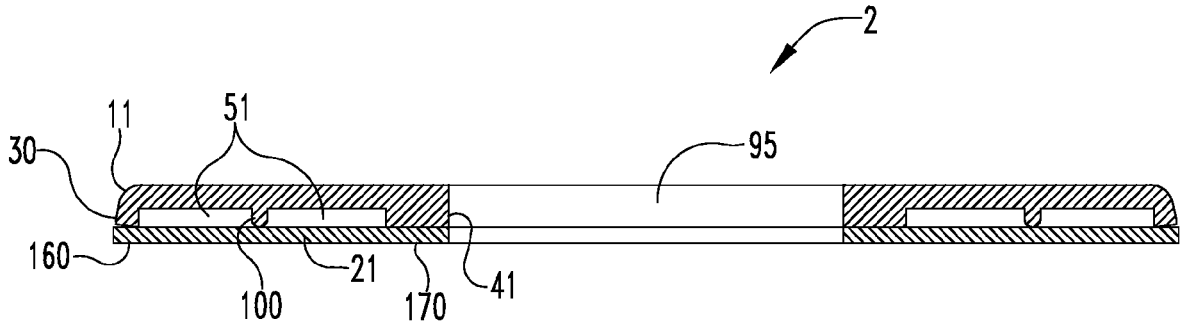
FIG. 2 illustrates a lateral view of a support for a pad assembly that includes a backing disk having inner and outer collars, a compensating disk positioned over the collars creating a cavity therebetween, and a single ridge within the cavity.
Figure 3:
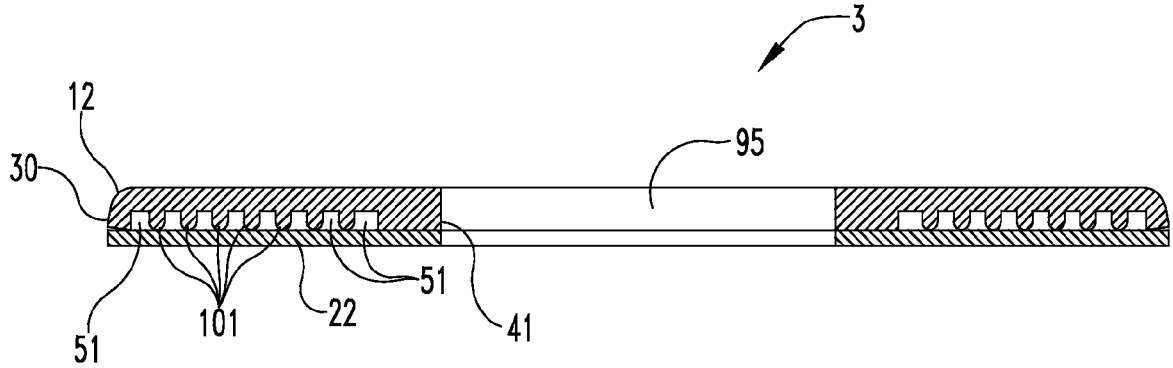
FIG. 3 illustrates a lateral view of a support for a pad assembly that includes a backing disk having inner and outer collars, a compensating disk positioned over the collars creating a cavity therebetween, and a plurality of ridges within the cavity.

A more detailed description of the disclosure follows and refers to the appended drawings. FIG. 1 illustrates a support combination 1 that includes backing disk 10 having an outer collar 30 and an inner collar 41 on the backing disk's second side and compensating disk 20 having an outer region 160 and an inner region 170. The compensating disk's outer region 160 rests on outer collar 30 whereas its inner region 170 rests on inner collar 41, creating cavity 50 between backing disk 10 and compensating disk 20. Although outer collar 30 and inner collar 41 are shown having a blunt upper surface, the collar's upper surface can be sharp or curved. The preferred compensating disks illustrated in this figure and other figures having a compensating disk resting on inner and outer collars have some ability to flex upon encountering a force above cavity 50 between the inner and outer regions. Compensating disks made of rubber materials such as Viton, silicon rubber, and the like are preferred in these embodiments (FIGS. 1-3). Outer region 160 and inner region 170 of compensating disk 20 can be maintained in position by friction that results from installation into a pad assembly, the presence of a narrow ridge on the surface of collars 30 and/or 41 that can be sharp, rounded or blunt, or the compensating disk 20 can be maintained in position with an adhesive layer between the upper surfaces of collars 30 and 41 and the first surface of compensating disk 20. Sealing the interface between collars 30 and 41 and compensating disk 20 can create a trapped air space within the cavity. Because of the trapped air, deflection of the compensating disk 20 results in an increased pressure within the cavity that makes further deflection more difficult. Although air is currently the preferred fluid, it can be replaced with other fluids, including liquids, to further affect the compressibility of the compensating disk. Finally a similar effect can be achieved by inserting a hollow O-ring into the cavity with or without a compensating disk. Preferred hollow O-rings can have a circular, rectangular or square cross-section, are constructed from an elastic material such as natural rubber, Viton and the like and contain internally a fluid that can be a gas or liquid. Air is a preferred fluid.

FIG. 2 illustrates a modification of the support illustrated in FIG. 1. Support 2 additionally includes a ridge 100 located radially along cavities 51 beneath compensating disk 21. Ridge 100 reduces the magnitude of displacement of compensating disk 21 into cavities 51 upon encountering a force on the second side of disk 21 above cavities 51. Ridge 100 can have a curved, blunt, or sharp surface and can extend all of the way or part of the way to the first side of compensating disk 21.

FIG. 3 illustrates support 3, a further modification of support 1 (FIG. 1) having a plurality of ridges 101 located radially about the second surface of backing disk 12 within cavities 51. Pad assemblies containing support 3 with ridges 101 positioned closely to each other and/or having ridges 101 abutting or nearly abutting the first surface of compensating disk 22 have a more firm touch and a more limited ability to self-adjust. Pad assemblies containing support 3 with ridges 101 positioned apart from each other and/or having ridges 101 that extend only a portion of the way to the first surface of compensating disk 22 have a generally softer touch and an increased ability to self-adjust.

Figure 4:
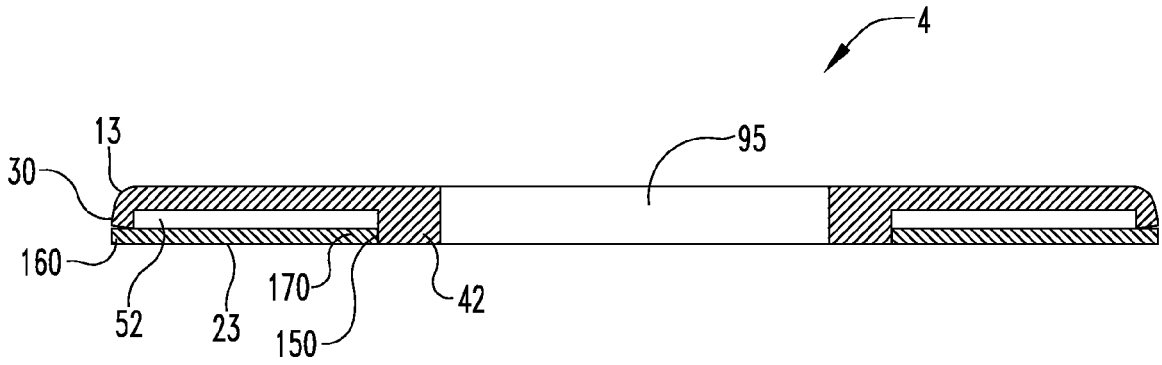
FIG. 4 illustrates a lateral view of a support that includes a backing disk having inner and outer collars and a compensating disk positioned over the outer collar and abutting the inner collar creating a cavity therebetween.

FIG. 4 illustrates a further modification of support 1 (FIG. 1). Support 4 includes a backing disk 13 having outer collar 30 and inner collar 42 on its second surface and compensating disk 23 having an outer region 160 that rests on outer collar 30 and an inner region 170 that extends in the direction of and abuts the outer edge 150 of inner collar 42. The inner region 170 of compensating disk 23, lacking an inner support, can readily flex into cavity 52. Pad assemblies containing support 4 have the ability to self adjust upon contacting a tone hole having one or more high regions. The ability for a pad assembly including support 4 to self adjust can be increased by making compensating disk 23 more flexible and/or making cavity 52 deeper. The flexibility of compensating disk 23 can be increase by the selection of its material of construction, by decreasing its thickness and by placing a plurality of slits radially about its inner region (See FIG. 8). Preferred materials of construction for compensating disk 23 include metal and polymeric materials having "spring-like" properties.

Figure 5:
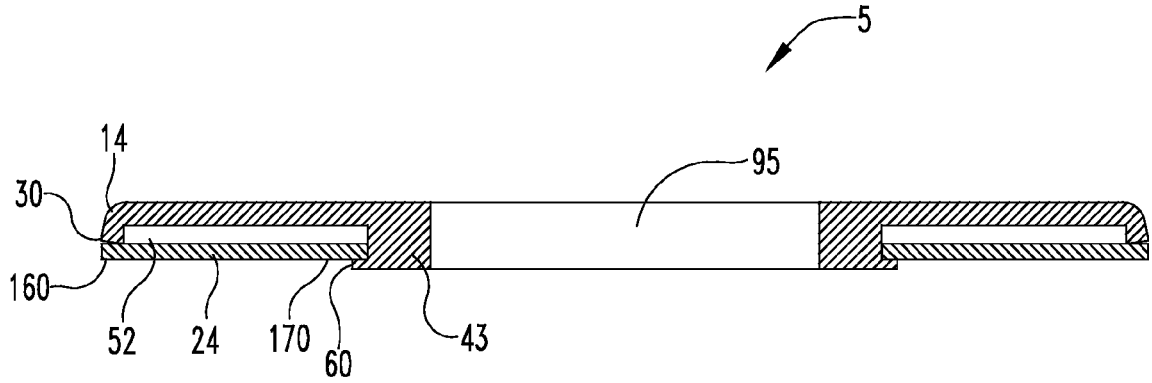
FIG. 5 illustrates a lateral view of a support for a pad assembly that includes a backing disk having inner and outer collars, a compensating disk positioned over the outer collar and abutting the inner collar creating a cavity therebetween, and a lip atop the inner collar in contact with the inner region of the compensating disk.

FIG. 5 illustrates support 5, a modification of support 4 (FIG. 4), additionally including lip 60 on the outer edge of inner collar 43. In a pad assembly containing support 5, lip 60 shields the inner region of the compensating disk 24 from contact with a cushion layer (110 in FIG. 9) allowing a deflected inner region 170 of compensating disk 24 to return to an un-deflected position without interference from the cushion layer. Lip 60 can be a contiguous part of collar 43 or a separate "washer like" structure in combination with backing disk 10, 11, 12 or 13 (FIGS. 1, 2, 3, and 4, respectively). The two-piece combination can provide a functional equivalent of collar 43. For support combinations where compensating disk 24 lacks sufficient flexibility to be easily installed under lip 60, the two-piece combination is preferred.

Figure 6:
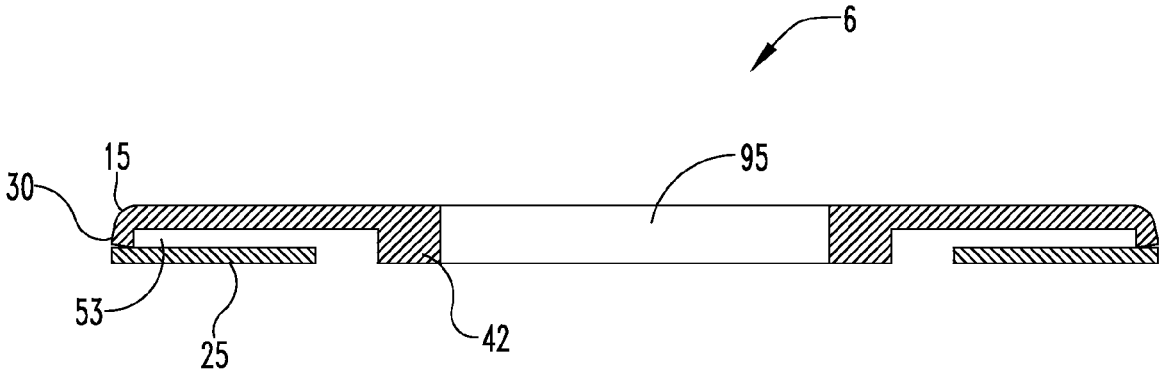
FIG. 6 illustrates a lateral view of a support for a pad assembly that includes a backing disk having inner and outer collars and a compensating disk positioned over the collars extending in the direction of the inner collar and creating a pocket therebetween.

FIG. 6 illustrates a further modification of support 4 (FIG. 4) having a compensating disk 25 that extends only part of the distance toward inner collar 42. Although compensating disk 25 in FIG. 6 illustrates a particular degree of extension in the direction of inner collar 42, all degrees of extension are contemplated and are intended to be illustrated by this figure.

Figure 7:
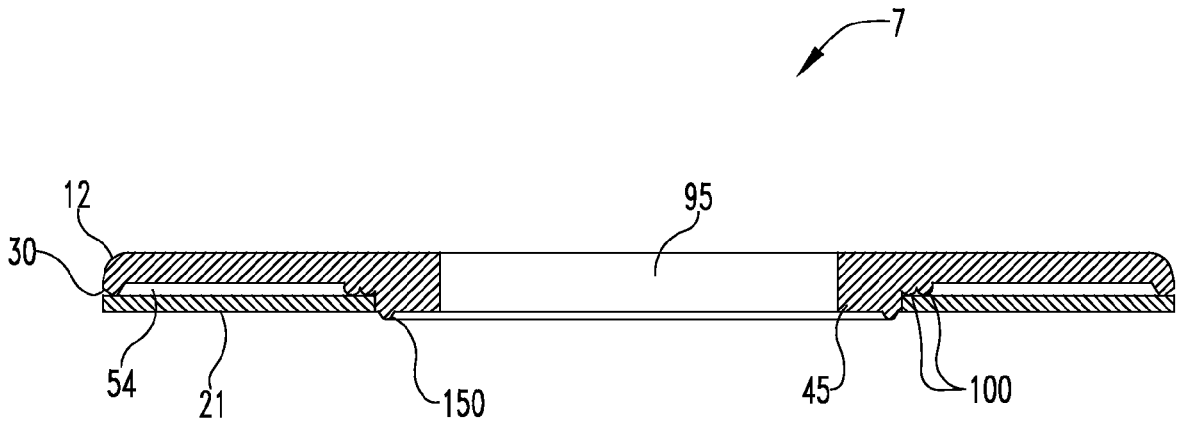
FIG. 7 illustrates a lateral view of a support for a pad assembly that includes a backing disk having inner and outer collars and a compensating disk positioned over the outer collar abutting the inner collar creating a cavity therebetween, and a plurality of ridges within the cavity proximate the inner collar.

FIG. 7 illustrates support 7, a modification of support 4 (FIG. 4) having at least two ridges 100 located radially about the second surface of backing disk 12 within cavity 54 proximate inner collar 45. Outer collar 30 and ridges 100 both have sharp surfaces that runs radially about the collar and ridge. Inner collar 45 has a ridge 150 running radially about the collar's surface.

Figure 8:
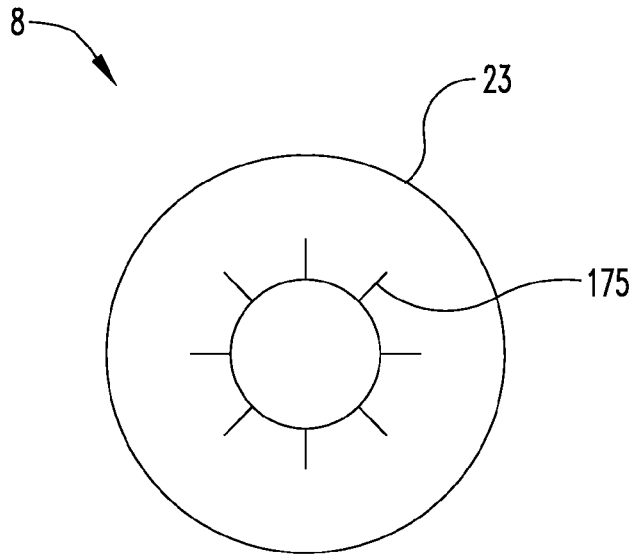
FIG. 8 illustrates an end-view of a compensating disk having a plurality of radial slits within the compensating disk's inner region.

FIG. 8 illustrates an end-view of compensating disk 23 having a plurality of slits 175 positioned radially about the disk's inner region. The slits 175 increase the flexibility of the compensating disk 23. Flexibility can be increased further by increasing the number of slits and by increasing their depth toward the outer region of compensating disk 23.

FIGS. 9-14 illustrate several pad assemblies including supports 1 and 7 or a modification of support 1. Supports 2-7 and their variations can be substituted for support 1 in the various pad assemblies.

Figure 9:
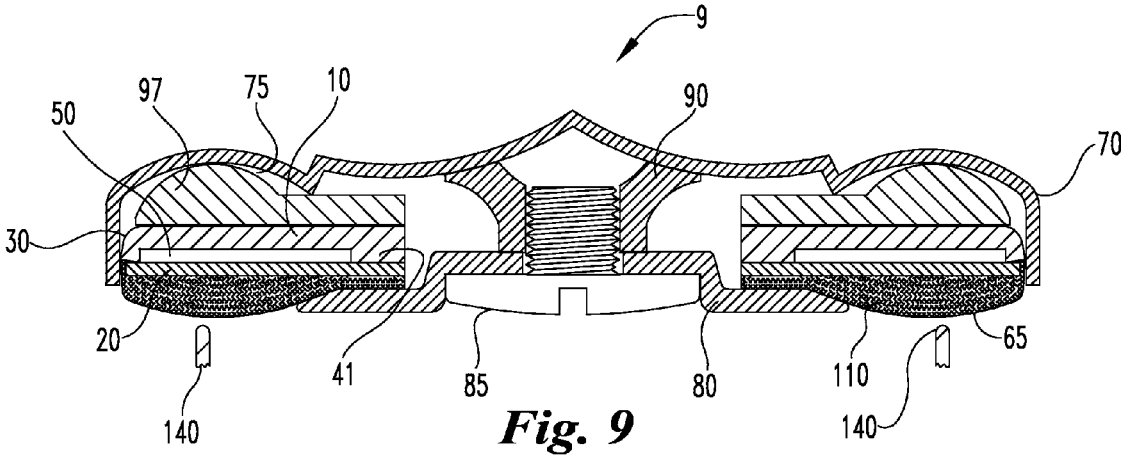
FIG. 9 illustrates a lateral view of a flute pad assembly including a support illustrated in FIG. 1 comprising a backing disk having inner and outer collars and a compensating disk positioned over the collars creating a cavity therebetween.

FIG. 9 illustrates pad assembly 9 including support 1 (FIG. 1). Support 1 is fitted into pad cup 70 against stabilizing disk 97. Cushion layer 110 is fitted against the second side of compensating disk 20 and covered with skin 65. Backing disk 10, compensating disk 20, cushion layer 110 and skin 65 are held in place within pad cup 70 by washer 80 and screw 85 threaded into pad nut 90. The same components can be held in place within an open hole pad assembly by a standard friction collar.

Upon contacting tone hole surface 140, the force exerted on skin 65 and flexible cushion 110 is transferred to compensating disk 20 causing it to flex into cavity 50 and allowing skin 65 and cushion 110 to adjust to the contour of the tone hole sealing surface 140. The degree of flexing achieved by compensating disk 20 depends on the material of construction and thickness of compensating disk 20 as well as the depth of cavity 50, and whether or not cavity 50 is fitted with one or a plurality of ridges as shown in FIGS. 2 and 3.

Figure 10:
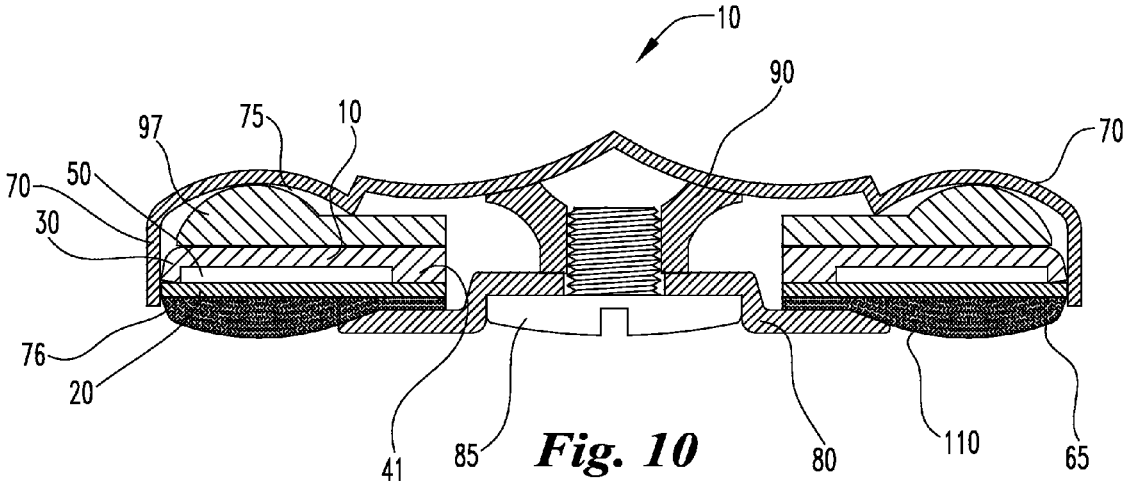
FIG. 10 illustrates a lateral view of a flute pad assembly including a support illustrated in FIG. 2 comprising a backing disk having inner and outer collars and a compensating disk positioned over the collars creating a cavity therebetween and having an adhesive layer between the compensating disk and the cushion layer.

FIG. 10 illustrates a modification of pad assembly 9 (FIG. 9) having an adhesive layer 76 between compensating disk 20 and cushion layer 110. Adhesive layer 76 helps to coordinate the flexing of compensating disk 20 and cushion layer 110 and avoid any binding action between the two members. The adhesive utilized should be capable of bonding to a porous substrate and to the material of construction for compensating disk 20. Rubber cements, solutions of rubbers, and latex adhesives are currently preferred.

Figure 11:
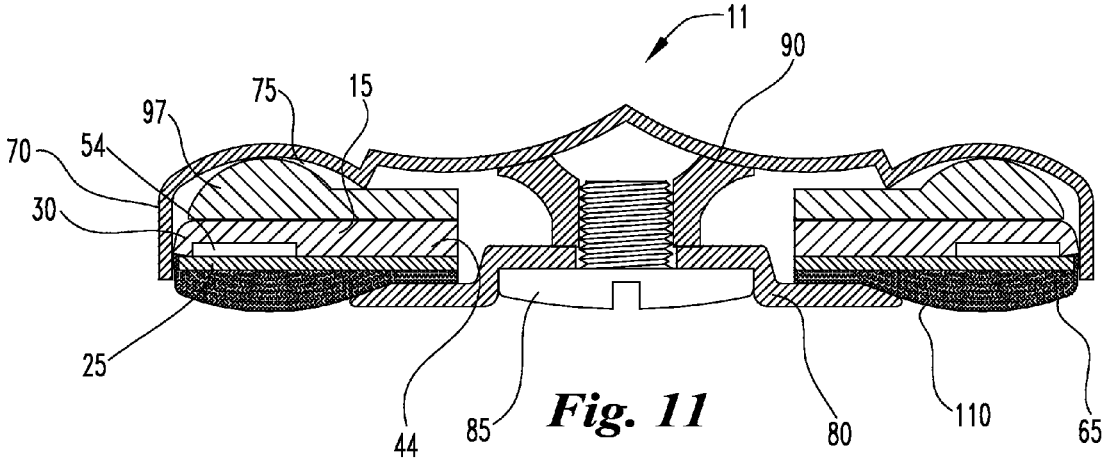
FIG. 11 illustrates a lateral view of a flute pad assembly that includes a backing disk having a broad inner collar, a more narrow outer collar; and a compensating disk positioned over the two collars creating a cavity therebetween.

FIG. 11 illustrates a further modification of pad assembly 9 (FIG. 9) including a backing disk 15 having a broad inner collar 44. Inner collar 44 provides greater support for the inner region of cushion 110 and prevents an overly secured washer 80 and screw 85 combination from forcing cushion 110 and compensating disk 25 into cavity 54 during assembly.

Figure 12:
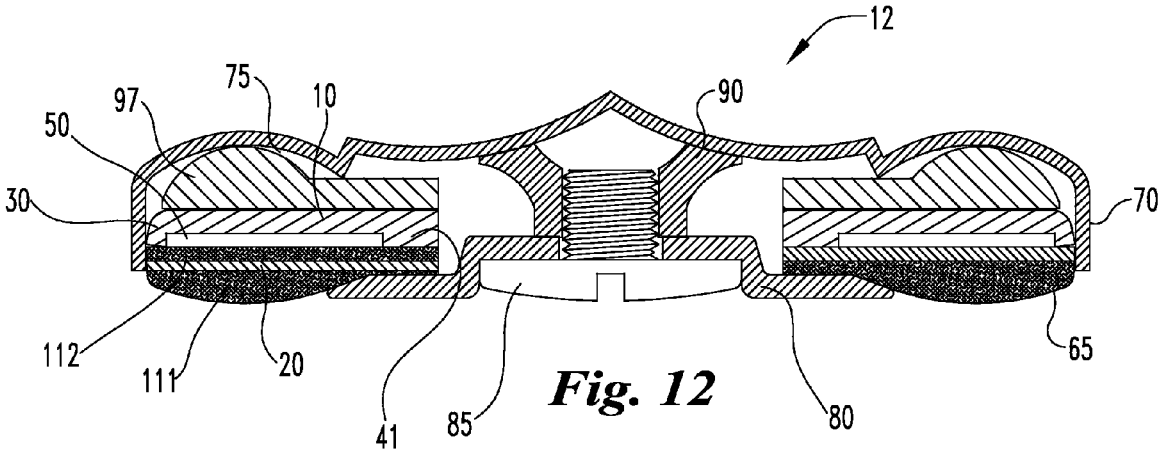
FIG. 12 illustrates a lateral view of a flute pad assembly including a support comprising a backing disk having inner and outer collars and a compensating disk positioned over the collars and between two cushion layers creating a cavity therebetween.

FIG. 12 illustrates a still further variation of pad assembly 9 (FIG. 9) including compensating disk 20 sandwiched in between two cushion layers 111 and 112. Flexible members, other than cushion layer 112 can be similarly placed between the compensating disk 20 and backing disk 10 according to this present disclosure. As illustrated in FIG. 8, one or more adhesive layers can be placed between compensating disk 20 and cushion layers 111 and 112.

FIGS. 9-14 have illustrated pad assemblies containing support 1 (FIG. 1) and variations thereof described herein. Supports 2-6 and described variations thereof can be substituted for support 1 to provide additional embodiments of the disclosed pad assemblies. All such pad assemblies having any combination of features described herein are hereby disclosed and can be prepared by one skilled in the art based on this disclosure.

Figure 13:
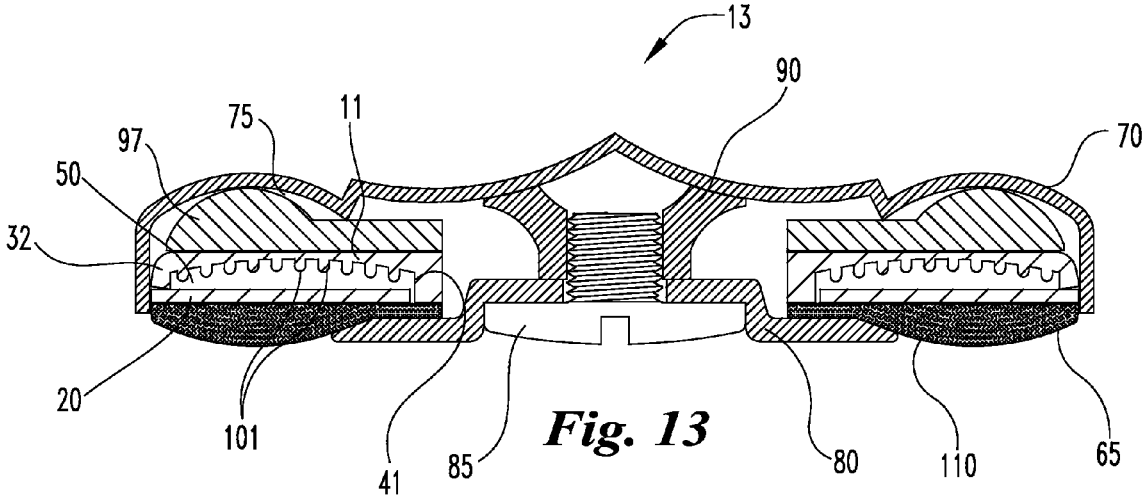
FIG. 13 illustrates a lateral view of a flute pad assembly including a backing disk having inner and outer collars and a plurality of ridges therebetween having different heights.

FIG. 13 illustrates pad assembly 13 having collars 32 and 41 on the second surface of baking disk 11 forming cavity 50. Cavity 50 contains a plurality of ridges 101 within cavity 50, wherein the ridges 101 have different heights. The shorter ridges 101 are placed near the center of cavity 50.

Figure 14:
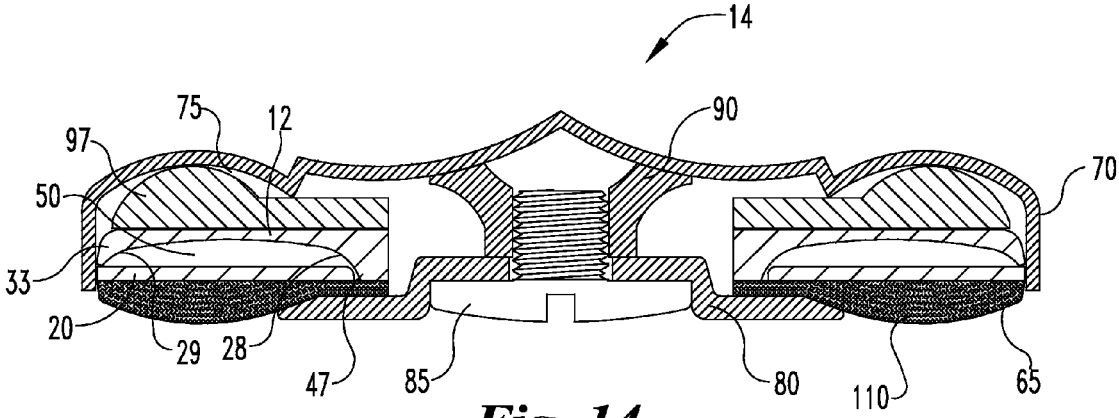
FIG. 14 illustrates a lateral view of a flute pad assembly including a backing disk having inner and outer collars, the collars having curved walls or edges forming a generally concave cavity therebetween.

FIG. 14 illustrates pad assembly 14 having outer collar 33, inner collar 47, both collars having curved walls or edges 28 and 29 forming a generally concave cavity 50 between backing disk 12 and compensating disk 20. The outer and inner regions of compensating disk 20 reach and are supported by curved walls 28 and 29, but neither region reaches the surface of collars 33 and 47.

Figure 15:
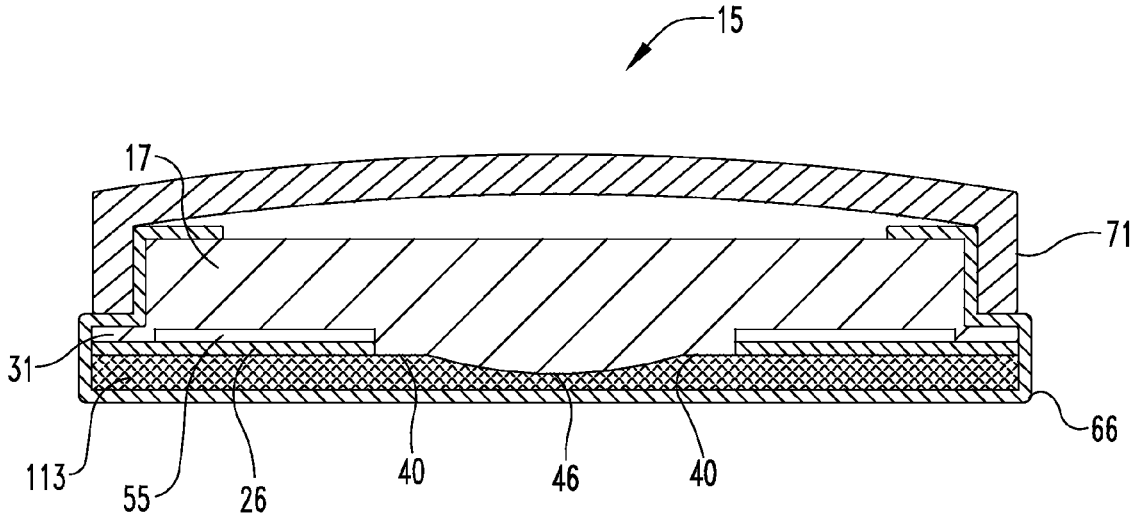
FIG. 15 illustrates a lateral view of a clarinet pad assembly including a support comprising a backing disk having inner and outer collars and a compensating disk positioned over the collars creating a cavity therebetween.

FIG. 15 illustrates pad assembly 15, particularly suitable for use in a clarinet. Pad assembly 15 comprises a support that includes backing disk 17 and compensating disk 26 contained in pad cup 71. Backing disk 17 has an outer collar 31 that supports the outer region of compensating disk 26 and inner collar 40 to which compensating disk 26 abuts. As illustrated, inner collars 40 can be contiguous with centrally raised surface 46.

Figure 16:
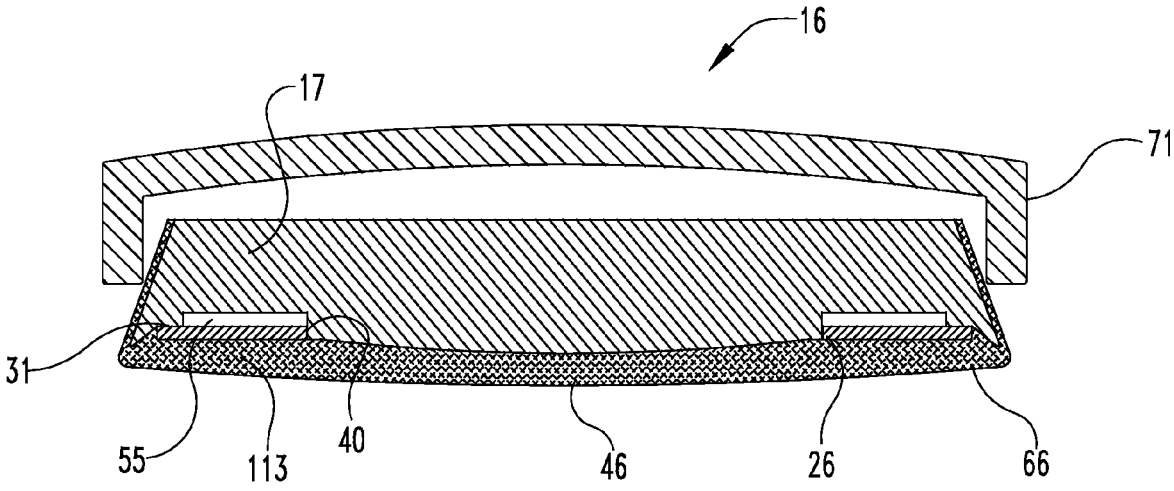
FIG. 16 illustrates a lateral view of a piccolo pad assembly including a support comprising a backing disk having inner and outer collars and a compensating disk positioned over the collars creating a cavity therebetween.

FIG. 16 illustrates pad assembly 16, particularly suitable for use in a piccolo. Pad assembly 16 comprises a support that includes backing disk 17 and compensating disk 26 contained in pad cup 71. Backing disk 17 has an outer collar 31 that supports the outer region of compensating disk 26 and inner collar 40 to which compensating disk 26 abuts. As illustrated, inner collars 40 can be contiguous with centrally raised surface 46.

Figure 17:
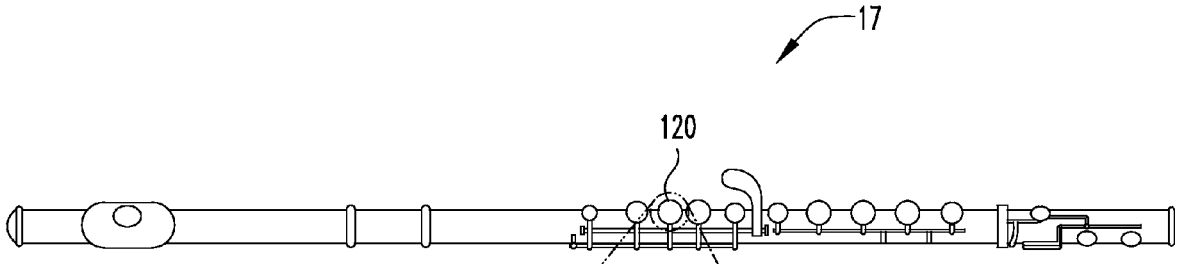
FIG. 17 illustrates a flute having the pad assembly 9 installed therein.
Figure 17A:
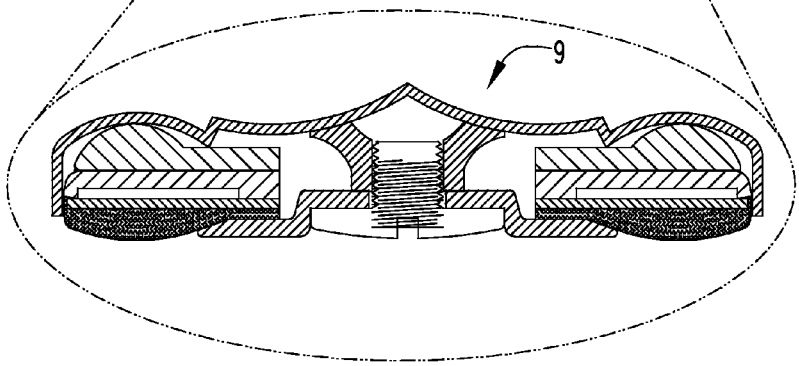

FIG. 17 illustrates flute 17 having pad assembly 9 illustrated in FIG. 17(*a*) (see FIG. 9 for detailed structure) installed in assembly 120. Pad assemblies 10-14 (FIGS. 10-14) and the additional embodiments described herein can be substituted for pad assembly 9 in assembly 120, or elsewhere in flute 17.

Figure 18:
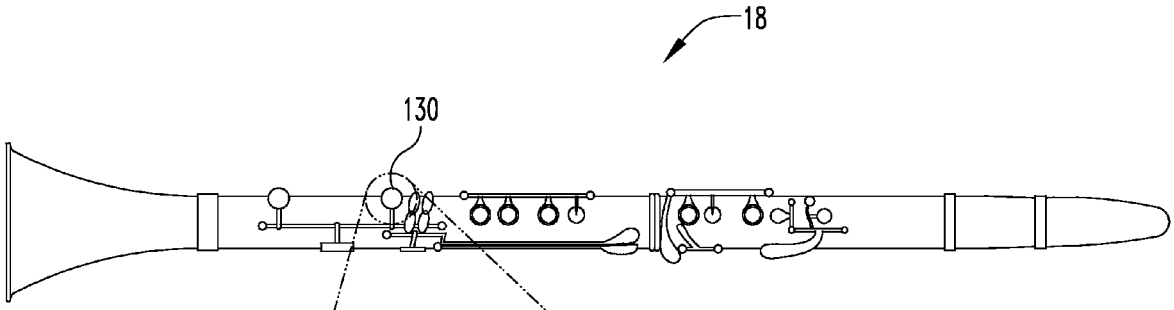
FIG. 18 illustrates a clarinet having the pad assembly 15 installed therein.
Figure 18A:
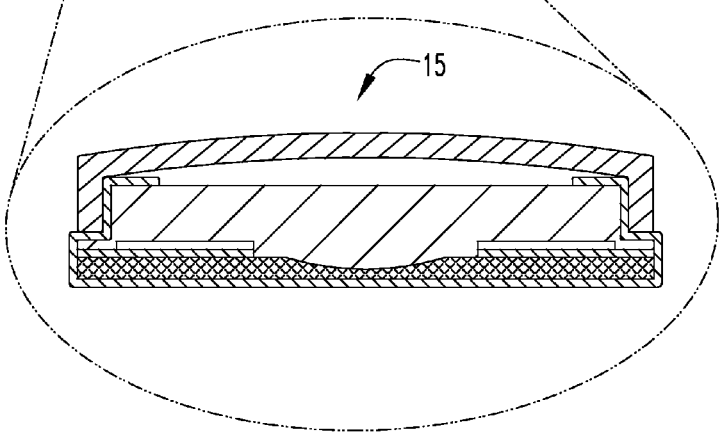

FIG. 18 illustrates clarinet 18 having pad assembly 15 illustrated in FIG. 18(*a*) (see FIG. 15 for detailed structure) installed in assembly 130. The additional embodiments described herein can similarly be substituted for pad assembly 15 in assembly 130, or elsewhere in clarinet 18.

Figures 19, 19A:
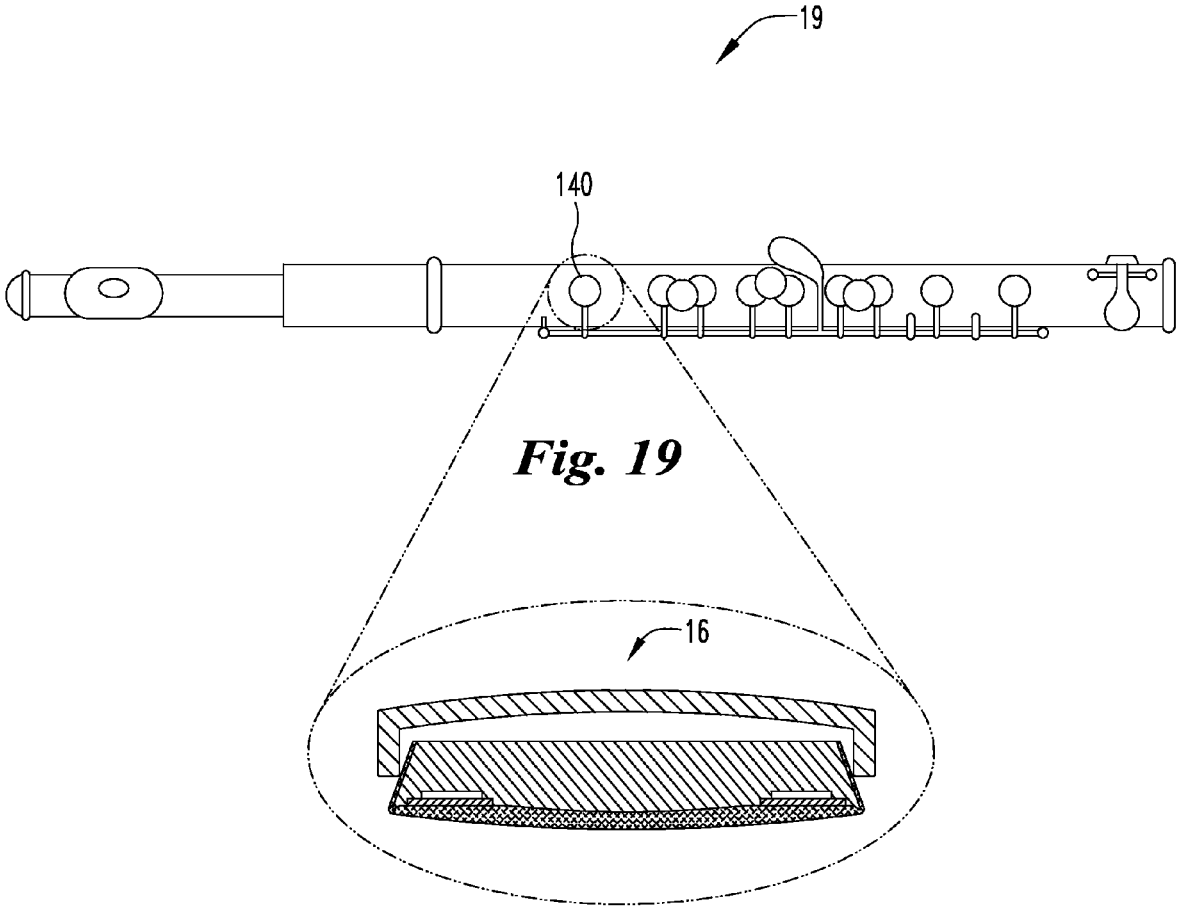
FIG. 19 illustrates a piccolo having the pad assembly 16 installed therein.

FIG. 19 illustrates piccolo 19 having pad assembly 16 illustrated in FIG. 19(*a*) (see FIG. 16 for detailed structure) installed in assembly 140. The additional embodiments described herein can similarly be substituted for pad assembly 16 or elsewhere in piccolo 19.

The preferred compensating disks illustrated in this figure and other figures in which the compensating disk rests on inner and outer collars have some ability to bend or flex upon encountering a force. The bending or flexing can result from the inner region of the compensating disk flexing or pivoting into the cavity from the region supported by the outer collar 30 or can similarly result due to a stretching of the compensating disk, depending on the material of construction and it's thickness.

The novel backing and compensating disks illustrated in FIGS. 1 through 11 can be machined from stock metal or polymeric materials or molded from reactive polymers or polymers having a sufficiently low glass transition temperature utilizing methods known to those skilled in the art. Materials that have proven particularly suitable include aluminum, polypropylene, polyethylene, polyoxymethylene(acetal), and polytetrafluroethylene.

The methods for utilizing the novel backing disks and pad assemblies disclosed and claimed herein for tone hole coverings for woodwinds, particularly flutes, and conforming their sealing surface to a tone hole are well known and have been described in the art.

Certain embodiments of this disclosure can be used to replace pad assemblies in older instruments and in original equipment. In addition, the embodiment's sealing surface can be made to conform to the tone hole surface with a variety of known techniques. Depending on the level of flexibility available to a compensating disk a normal leveling technique may be required or only a cursory leveling procedure may be used. As a result, embodiments of applicant's novel pad assemblies are suitable for use in a range of instruments from hand made flutes used by professional musicians to the less expensive student flutes.

Applicant's new pad assemblies having the novel support disclosed are not only better able to conform to the surface of a tone hole, but can be made to maintain the necessary level of support for the pad's sealing surface and maintain an even tension on the pad's skin. As a result, the pad's surface continues to provide a superior seal with fewer tears of the skin.

While applicant's invention has been described in detail above with reference to specific embodiments, it will be understood that modifications and alterations in embodiments disclosed may be made by those practiced in the art without departing from the spirit and scope of the disclosure. All such modifications and alterations are intended to be covered. In addition, all publications cited herein are indicative of the level of skill in the art and are hereby incorporated by reference in their entirety as if each had been individually incorporated by reference and fully set forth.

I claim:

1. Support for a pad assembly for the closure of a wind instrument's tone hole, the support comprising a backing disk and a compensating disk, the backing disk having a first surface, a second surface, an inner collar and an outer collar, the inner and outer collars positioned on the backing disk's second surface, and a compensating disk having a first surface, a second surface, an outer region and an inner region, the compensating disk's outer region adapted to be positioned over the outer collar and the compensating disk's inner region adapted to extend in the direction of the inner collar creating a cavity between the backing disk's second surface and the compensating disk's first surface.

2. The support of claim 1, wherein the outer collar has a height of from about 0.002 to about 0.012 inch.

3. The support of claim 1, wherein an adhesive layer is positioned between the compensating disk and at least one collar

4. The support of claim 1, wherein the inner region of the compensating disk is adapted to be positioned over the cavity without resting on the inner collar.

5. The support of claim 1, wherein the inner region of the compensating disk is adapted to be positioned on the inner collar.

6. The support of claim 1, wherein the backing disk is constructed of a metal.

7. The support of claim 1, wherein the backing disk is constructed of a polymer.

8. The support of claim 1, wherein the second surface of the backing disk has at least one ridge adapted to be positioned within the cavity beneath the compensating disk.

9. The support of claim 7, wherein the polymer is selected from the group consisting of polypropylene, polycarbonate, polyethylene, polyoxymethylene(acetal) and polytetrafluoroethylene.

10. The support of claim 1, wherein the compensating disk is constructed of a material selected from the group consisting of a metal, a polymer, and a rubber.

11. The support of claim 10, wherein the compensating disk is constructed of a metal.

12. The support of claim 10, wherein the metal is selected from the group consisting of steel, brass, titanium, copper, nickel, tin and aluminum.

13. The support of claim 10, wherein the compensating disk is constructed of a polymer.

14. The support of claim 13, wherein the polymer is selected from the group consisting of polypropylene, polycarbonate, polyethylene, polyoxymethylene(acetal) and polytetrafluoroethylene.

15. The support of claim 10, wherein the compensating disk is constructed of a rubber.

16. The support of claim 15, wherein the rubber is selected from the group consisting of neoprene rubber, a fluoroelastomeric rubber, silicone rubber, natural rubber, nitrile rubber, latex rubber, styrene butadiene rubber, Hypalon® rubber, polyisoprene rubber, EPDM rubber and polyurethane rubber.

17. The support of claim 4, wherein the inner collar is taller than the outer collar.

18. The support of claim 17, wherein the inner collar has a lip that curves outward and the inner region of the compensating disk approaches the outer collar beneath the lip.

19. The support of claim 18, wherein the height of the outer collar is from about 0.002 to about 0.012 inch.

20. The support of claim 4, wherein the inner region of the compensating disk has a plurality of slits extending radially in the direction of the outer region.

21. The support of claim 1, wherein the at least one collar has a ridge about the collar's upper surface.

22. A pad assembly for closure of a wind instrument tone hole comprising:

(a) the support of claim 4;

(b) at least one cushion layer in contact with the second surface of said compensating disk; and (c) a sealing surface in contact with at least one cushion layer and covering said cushion layer.

23. A pad assembly for closure of a wind instrument tone hole comprising:

(a) the support of claim 5;

(b) at least one cushion layer in contact with the second surface of said compensating disk; and (c) a sealing surface in contact with at least one cushion layer and covering said cushion layer.

24. A pad assembly for closure of a wind instrument tone hole comprising:

(a) a backing disk having a first surface, a second surface, an inner collar and an outer collar, the inner and outer collars positioned on the backing disk's second surface;

(b) a compensating disk having a first surface, a second surface, an outer region and an inner region, the compensating disk's outer region adapted to be positioned over the outer collar and the compensating disk's inner region adapted to extend in the direction of the inner collar creating a cavity between the backing disk's second surface and the compensating disk's first surface;

(c) a cushion layer in contact with a surface of the compensating disk; and (d) a sealing surface covering said cushion layer.

25. The pad assembly of claim 24, having a single cushion layer in contact with the compensating disk's second surface, wherein the compensating disk's first surface is in contact with the outer collar.

26. The pad assembly of claim 25, wherein an adhesive layer is positioned between the cushion layer and the compensating disk.

27. The pad assembly of claim 24, having a first cushion layer and a second cushion layer, the first cushion layer in contact with the compensating disk's first surface and the second cushion layer in contact with the compensating disk's second surface.

28. The pad assembly of claim 27, having an adhesive layer positioned between the first cushion layer and the compensating disk.

29. The pad assembly of claim 27, having an adhesive layer positioned between the second cushion layer and the compensating disk.

30. A wind instrument having the pad assembly for the closure of a tone hole, the pad assembly comprising:

(a) a backing disk having a first surface, a second surface, an inner collar and an outer collar, the inner and outer collars positioned on the backing disk's second surface;

(b) a compensating disk having a first surface, a second surface, an outer region and an inner region, the compensating disk's outer region adapted to be positioned over the outer collar and the compensating disk's inner region adapted to extend in the direction of the inner collar creating a cavity between the backing disk's second surface and the compensating disk's first surface;

(c) a cushion layer in contact with a surface of the compensating disk; and (d) a sealing surface covering said cushion layer.

31. The wind instrument of claim 30, wherein the wind instrument is a flute.

* * * * *